US005586458A

United States Patent [19]

Weinerman et al.

[11] Patent Number: 5,586,458

[45] Date of Patent: Dec. 24, 1996

[54] HANDLE OPERABLE ROTARY LATCH AND LOCK

[75] Inventors: Lee S. Weinerman, Medina; Scott A. Arthurs, Brunswick, both of Ohio

[73] Assignee: The Eastern Company, Cleveland, Ohio

[21] Appl. No.: 577,717

[22] Filed: Dec. 22, 1995

Related U.S. Application Data

[63] Continuation-in-part of Ser. No. 510,470, Aug. 2, 1995, Pat. No. 5,564,295, which is a continuation of Ser. No. 145,691, Oct. 29, 1993, Pat. No. 5,439,260.

[51] Int. Cl.[6] ..... E05C 3/26

[52] U.S. Cl. ..... 70/208; 70/472; 292/240

[58] Field of Search ..... 70/208, 109, 467, 70/489; 292/34, 36, DIG. 31, 240

[56] References Cited

U.S. PATENT DOCUMENTS

| | | | |
|---|---|---|---|
| 2,729,089 | 1/1956 | Pelcin | 70/151 |
| 3,333,878 | 8/1967 | Pelcin | 292/37 |
| 4,309,884 | 1/1982 | Davis | 70/472 |
| 4,312,203 | 1/1982 | Davis | 70/472 |
| 4,320,642 | 3/1982 | Pastva | 70/472 |
| 4,438,964 | 3/1984 | Peters | 292/216 |
| 4,641,865 | 2/1987 | Pastva | 292/5 |
| 4,706,478 | 11/1987 | Swan et al. | 70/208 |
| 4,892,338 | 1/1990 | Weinerman et al. | 292/35 |
| 4,896,906 | 1/1990 | Weinerman et al. | 292/48 |
| 4,911,487 | 3/1990 | Rachocki | 292/216 |
| 4,917,412 | 4/1990 | Swan et al. | 292/48 |
| 4,969,916 | 11/1990 | Weinerman et al. | 70/208 |
| 5,042,853 | 8/1991 | Gleason et al. | 292/126 |
| 5,058,937 | 10/1991 | Miehe et al. | 292/34 |
| 5,069,491 | 12/1991 | Weinerman et al. | 292/48 |
| 5,117,665 | 6/1992 | Swan et al. | 70/264 |
| 5,299,844 | 4/1994 | Gleason | 292/240 |
| 5,439,260 | 8/1995 | Weinerman et al. | 292/48 |

OTHER PUBLICATIONS

Versch Lock Mfg. Co., Inc., Columbia, SC, Two Untitled Product Information Sheets That Show RSL Series Paddle Locks, Date Unknown But Believed To Be Prior to Dec., 1995. See Also Two Pages of Versch Product Photos.

TRI/Mark Corporation, New Hampton, IA, Three Untitled Product Information Sheets (Believed To Be pp. 8,11 & 12 From A TRI/Mark Catalog) That Show Locks Of The 30–175, 30–400 and 30–450 Series, Date Unknown But Believed to be Prior to Dec. 1995.

(List continued on next page.)

*Primary Examiner*—Lloyd A. Gall
*Assistant Examiner*—Tuyet-Phuong Pham
*Attorney, Agent, or Firm*—David A. Burge

[57] ABSTRACT

A slam-capable, flush-mountable, paddle handle operated rotary latch having a pan-shaped housing employs a single rotary jaw that is releasably retained in its latched position by a rotary pawl, with the latch having spaced first and second housing side plates that sandwich the rotary jaw, the rotary pawl and a torsion spring that biases the jaw toward an open position, with the side plates defining aligned first and second U-shaped notches that cooperate with a third U-shaped notch formed in the rotary jaw for concurrently receiving and latchingly retaining a suitably configured strike formation, with the first housing side plate being rigidly connected to the pan-shaped housing, and with the second housing side plate being rigidified in close proximity to its U-shaped notch by an integrally formed flange that extends transversely to bridge between the housing side plates. The pawl defines a release trigger which, when tripped, permits the jaw to be pivoted by the spring to an open position. An operating arm is connected to the housing for pivotal movement along a back wall of the housing for tripping the trigger in response to operation of the handle. The operating arm has opposed end regions, one of which engages the release trigger and is guided for movement by extending through a slot formed in the first side plate, the other of which is guided for movement by a backwall-mounted guide, and is engageable by a lockable cam for selectively permitting and preventing the handle and arm from moving to trip the trigger.

27 Claims, 9 Drawing Sheets

OTHER PUBLICATIONS

Cleveland Hardware, Cleveland, OH, One Untitled Product Information Sheet Showing A No. 1–2600–AH Lock, Date Unknown But Believed To Be Prior to Dec., 1995.

Eberhard Manufacturing Co. (Division Of The Eastern Company), Cleveland, OH, Catalog 106 Entitled "Industrial and Vehicular Hardware", 1994, pp. 4–9, 26, 32–36, 64–65 and 71–75.

General Motors Corp. , Detroit, MI, Photos Showing A Vehicle Handle Assembly Part No. 15686155 Which Has Been Available At Cheverolet Dealers Since At Least As Early As 1993.

HANDLE OPERABLE ROTARY LATCH AND LOCK

CROSS-REFERENCE TO RELATED AND RELEVANT CASES

The present application is a continuation-in-part of application Ser. No. 08/510,470 filed Aug. 2, 1995 by Lee S. Weinerman et al entitled HANDLE OPERABLE ROTARY LATCH AND LOCK, now U.S. Pat. No. 5,564,295, which, in turn, was filed as a continuation of application Ser. No. 08/145,691 filed Oct. 29, 1993 by Lee S. Weinerman et al entitled HANDLE OPERABLE ROTARY LATCH AND LOCK which issued Aug. 8, 1995 as U.S. Pat. No. 5,439,260, which applications are referred to hereinafter as the "Parent Cases," the disclosures of which are incorporated herein by reference.

Reference also is made to three concurrently-filed applications that also are continuations-in-part of the aforementioned application Ser. No. 08/510,470, namely: utility application Ser. No. 08/577,720 filed Dec. 22, 1995 by Lee S. Weinerman et al entitled HANDLE OPERABLE ROTARY LATCH AND LOCK; design application Ser. No. 29/048,262 filed Dec. 22, 1995 by Lee S. Weinerman et al entitled HANDLE AND HOUSING ASSEMBLY FOR LATCH OR LOCK; and, utility application Ser. No. 08/577,718 filed Dec. 22, 1995 by Lee S. Weinerman et al entitled HANDLE OPERABLE TWO-POINT LATCH AND LOCK. These three concurrently-filed applications are referred to hereinafter as the "Companion Cases," the disclosures of which are incorporated herein by reference.

BACKGROUND OF THE INVENTION

1. Field of the Invention

The present invention relates to a novel and improved slam-capable, flush-mountable, paddle handle operated rotary lock that employs a rotary latch assembly of a particularly desirable type connected to rear portions of a pan-shaped housing, with an operating arm that pivots to "unlatch" the latch in response to operation of the handle, with movement of the operating arm preferably being slot-guided at two spaced locations, one being near where the operating arm is engageable with a pawl of the rotary latch, and the other being near where the operating arm may be engaged by a housing-carried, key-operated lock assembly that selectively permits and prevents unlatching movements of the operating arm. More particularly, the present invention relates to a lock of the type described that preferably utilizes a rotary latch assembly that has a single rotary jaw that is releasably retained in its latched position by a rotary pawl, with the latch having spaced first and second housing side plates that sandwich the rotary jaw, the rotary pawl and a torsion spring that biases the jaw toward an open position, with the side plates defining aligned first and second U-shaped notches that cooperate with a third U-shaped notch formed in the rotary jaw for concurrently receiving and latchingly retaining a suitably configured strike formation, with one of the housing side plates being rigidly connected to the pan-shaped housing, with the other of the housing side plates being rigidified in close proximity to its U-shaped notch by an integrally formed flange that extends transversely to bridge between the housing side plates, and with the rotary pawl defining a release trigger which, when tripped by pivotal movement of the operating arm in response to operation of the handle, permits the rotary jaw to be pivoted by the spring to an open position.

2. Prior Art

Flush mountable, paddle handle operated latches and locks are known that employ rotary latch bolts, also referred to as "rotary jaws," wherein the jaws are provided with U-shaped strike-receiving notches for latchingly receiving and releasably retaining suitably configured strike formations. It also is known to utilize a spring-biased operating arm that is pivoted on a back wall of a pan-shaped housing to transfer "unlatching" movement from a rearwardly extending projection of a housing-pivoted paddle handle to a rotary latch assembly that is connected to the pan-shaped housing, as is exemplified by U.S. Pat. No. 4,320,642 issued Mar. 23, 1982 to John V. Pastva, Jr., entitled PADDLE LOCKS WITH HANDLE DISCONNECT FEATURES, the disclosure of which is incorporated herein by reference.

Other disclosures of latch and/or lock units that employ rotary jaws are found in U.S. Pat. No. 4,320,642 issued Mar. 23, 1982 to John V. Pastva, Jr., entitled PADDLE LOCKS WITH HANDLE DISCONNECT FEATURES; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 4,896,906 issued Jan. 30, 1990 to Lee S. Weinerman et al entitled VEHICLE DOOR LOCK; and, U.S. Pat. No. 5,069,491 issued Dec. 3, 1991 to Lee S. Weinerman et al entitled VEHICLE DOOR LOCK SYSTEM. The disclosures of these patents also are incorporated herein by reference.

The rotary latch and/or lock units that are disclosed in the four patents identified above are of a relatively heavy duty type that often are employed in "personnel restraint applications," typically on doors of passenger compartments of vehicles. These heavy duty units employ pairs of housing-mounted rotary jaws, with the jaws being sandwiched between pairs of housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of this patent is incorporated herein by reference.

3. The Referenced Parent Cases

Not addressed by the patents that are identified above is a long-standing need for a relatively light duty rotary latch that employs only a single rotary jaw instead of a pair of rotary jaws, that employs first and second housing side plates that define, respectively, first and second notches that are of generally U-shape, with the first and second U-shaped notches being positioned and aligned for cooperating with a third U-shaped notch that is formed in the single rotary jaw to receive and latchingly retain within the confines of the first, second and third notches a suitably configured strike formation, and with the latch making advantageous use of a transversely extending flange that is formed integrally with one of the first and second housing side plates to rigidify and strengthen housing side plate portions that define a strike-engaging surface of at least one of the aligned first and second U-shaped notches. Features of the inventions of the referenced Parent Cases address this need, and, in preferred practice, the present invention employs some of these features.

4. The Referenced Companion Cases

The referenced Companion Design Case relates to a design for a Handle and Housing Assembly that is employed in carrying out the preferred practice of the inventions of the two referenced Companion Utility Cases. The Companion Utility Cases relate to flush-mountable latches and locks that have operating mechanism components divided into "front" and "rear" sub-assemblies or "modules" to address needs that differ from those that are addressed by the present invention. The Companion Utility Cases are, however, relevant hereto inasmuch as the present invention and the inventions of the Companion Utility Cases utilize, in preferred practice, rotary latch subassembly features that are disclosed in the referenced Parent Cases.

SUMMARY OF THE INVENTION

The present invention provides a slam-capable, flush-mountable, paddle-handle-operated, single-jaw rotary latch assembly having a jaw-retaining rotary pawl that can be pivoted to "unlatch" the rotary latch by an operating arm that is connected to the housing for pivotal movement along a back wall of the housing for executing an "unlatching" movement in response to movement of the paddle-type handle from its normal, non-operated position to its operated position, with opposed end regions of the operating arm preferably being guided (for smooth operation throughout a lengthy service life) and well supported (to resist deformation under application of excessive force to the latch and lock unit) at a pair of spaced locations including one near where the operating arm is engageable with the rotary pawl, and the other near where the operating arm may be engaged by a housing-carried, key-operated lock assembly that selectively permits and prevents unlatching movements of the operating arm.

In preferred practice, the present invention makes use of a type of rotary latch assembly that is disclosed in the referenced Parent Cases. The Parent-Case type of rotary latch assembly that is employed in the preferred practice of the present invention includes an elongate, generally rectangular first housing side plate having opposed end regions near opposite ends of the length thereof, and defining a first U-shaped notch located near one of the opposed end regions of the first housing side plate; an elongate, generally rectangular second housing side plate having opposed end regions near opposite ends of the length thereof, and defining a second U-shaped notch located near one of the opposed end regions of the second housing side plate, with the second U-shaped notch being configured to substantially align with the first U-shaped notch; spacer means for extending transversely between, for rigidly connecting with, and for holding in substantially parallel relationship the first and second housing side plates, with the spacer means including a first spacer that extends along a first transverse axis that intersects each of the first and second housing side plates at a location that is relative near to the other end regions thereof, and with the spacer means also including a second spacer that extends along a second transverse axis that intersects each of the first and second housing side plates at a location that is substantially mid-way between the opposite ends thereof; with the rotary latch bolt means including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with the selected housing side plate.

A further feature provided by the preferred practice of the present invention has to do with a capability (that stems from providing the operating arm with proper support and with guides at a plurality of spaced locations to resist forceful deformation and to ensure smooth movement throughout a lengthy service life) of the well-supported, smooth-moving operating arm to be used with a variety of types of connections that may be selected for transferring movement from the paddle-type handle to the operating arm. For example, a connection formed by a handle-carried projection that extends rearwardly through a main back wall opening to directly engage the operating arm may be employed; or, in the alternative, a connection that employs an operating-arm-carried projection that extends forwardly through a main back wall opening to directly engage a portion of the paddle-type handle may be used. These and other forms of connection will function nicely with the well-supported, well-guided operating arm inasmuch as the operating arm does not rely on the character of the connection-establishing formations to provide proper support to ensure smooth movement of the operating arm or to resist deformation of the operating arm in the presence of an application of undue force.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
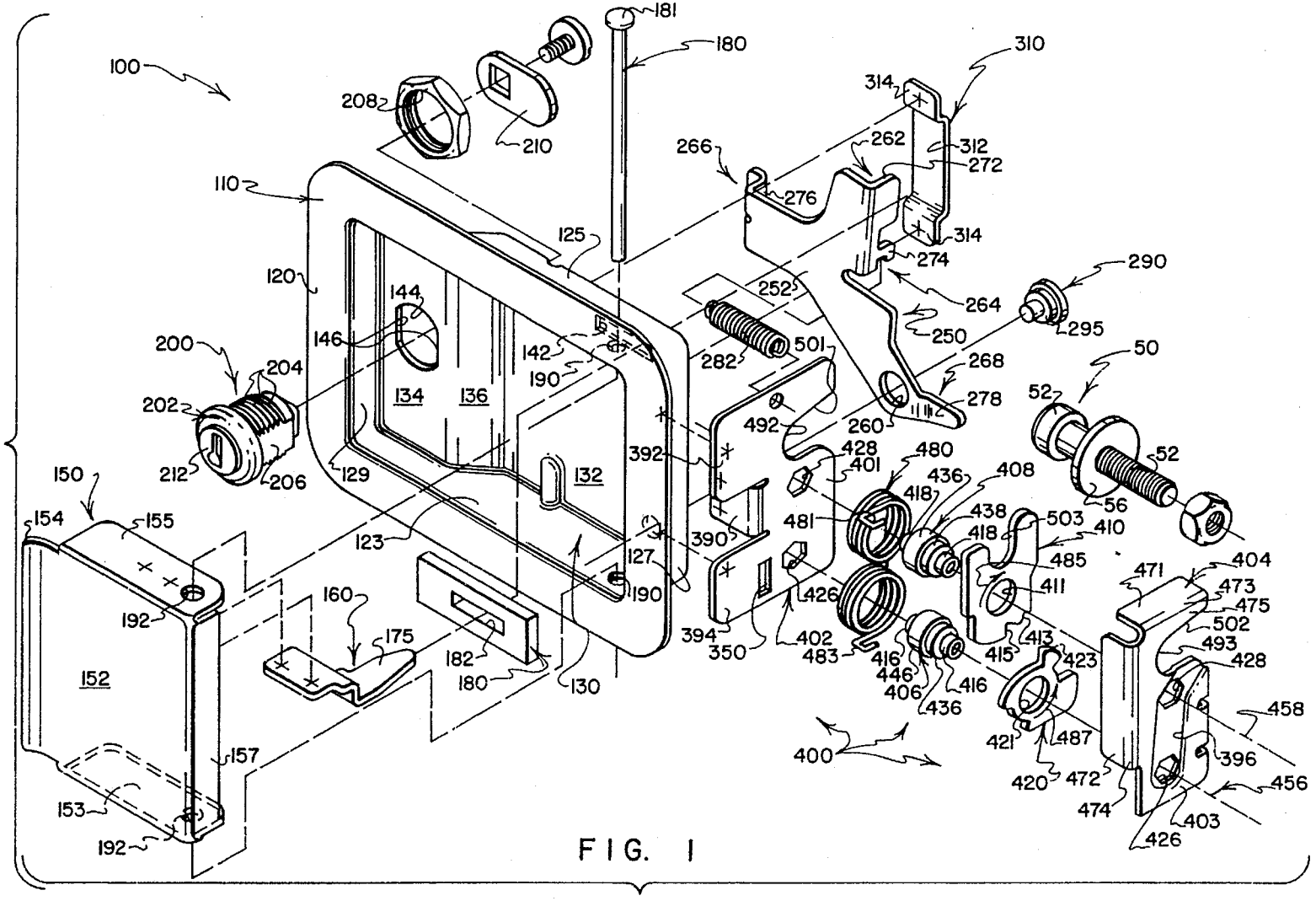
FIG. 1 is an exploded front perspective view of components of one embodiment of a handle operable rotary latch and lock unit that incorporates features of the preferred practice of the present invention, with a typical strike that can be engaged by the latch and lock unit also being shown.

Referring to FIGS. 1–6, one embodiment of a latch and lock unit representing the best mode known to the inventors for carrying out the preferred practice of the present invention is indicated generally by the numeral 100. The unit 100 has a pan-shaped housing 110 onto which are mounted a paddle-type operating handle 150, a key-operated cam lock assembly 200, an operating arm 250 and a rotary latch assembly 400.

Referring to FIG. 1, a typical strike that may be engaged by the latch and lock unit 100 is indicated generally by the numeral 50. As depicted, the strike 50 has threads on one end 52, an enlarged head 54 on the other end, and defines along its length a generally cylindrical formation 56—which is what is engaged by the rotary latch assembly 400. A locknut 58 is provided for engaging the threads 52 to mount the strike 50 on a door frame or other structure (not shown) that will be positioned adjacent the unit 100 when a closure (not shown) on which the unit 100 is mounted is in its closed position.

The pan-shaped housing 110 is a generally rectangular metal stamping having a perimetrically extending, substantially flat mounting flange 120 which surrounds a forwardly facing recess 130. Opposed, relatively long side walls 123, 125, and opposed, relatively short end walls 127, 129 are joined by smooth bends to the mounting flange 120.

A majority of the recess 130 is relatively deep, and is closed by a main back wall portion 132 that is substantially flat. One end region of the recess 130 is more shallow, and is closed by a minor back wall portion 134 that also is substantially flat. A slanted wall portion 136 forms a transition between the back wall portions 132, 134, and smooth bends join the back wall portions to adjacent portions of the side and end walls 123, 125, 127, 129.

A main back wall opening 142 (see FIGS. 3 and 4) is formed through the main back wall portion 132. A lock mount opening 144 (see FIG. 1) is formed through the minor back wall portion 134. The main back wall opening 140 is elongate, generally rectangular, is spaced a short distance from the housing side wall 123, and extends parallel to the housing side wall 123. The lock mount opening 144 is generally circular except for two flats 146 formed along opposite sides thereof.

Figure 5:
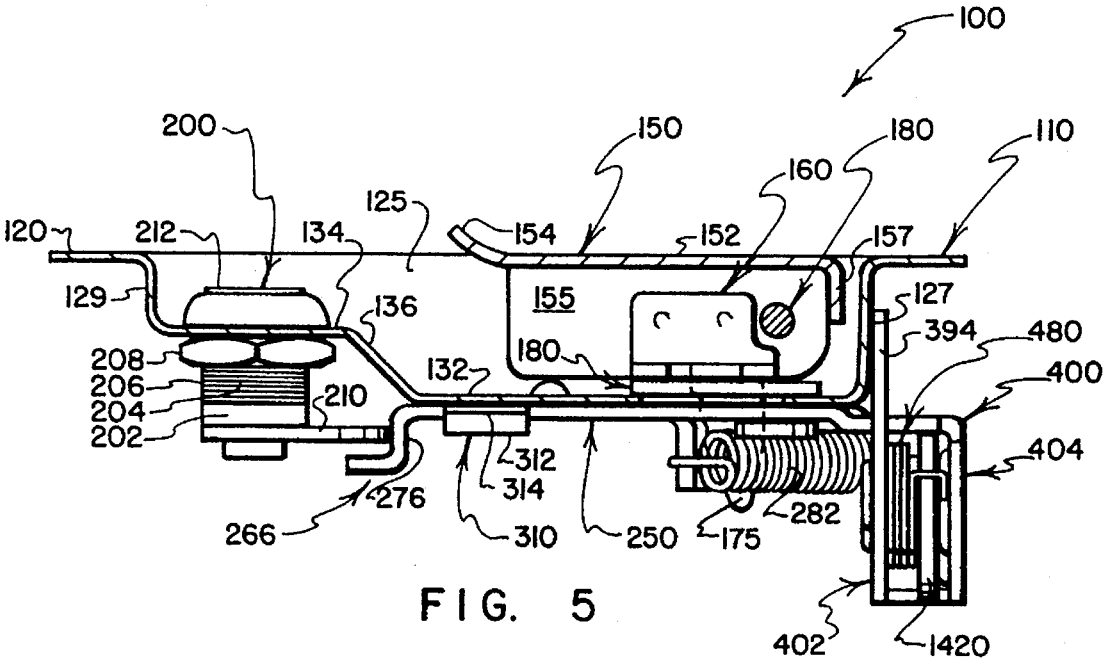
FIG. 5 is a sectional view as seen from planes indicated by a broken line 5—5 in FIG. 3.
Figure 6:
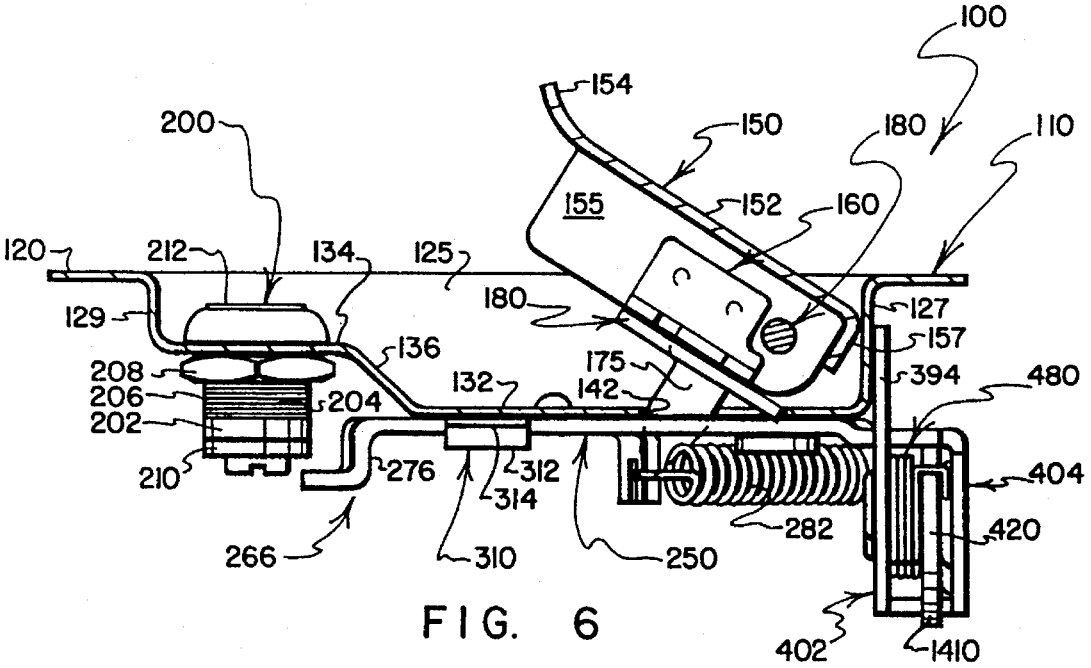
FIG. 6 is a sectional view as seen from planes indicated by a broken line 6—6 in FIG. 4.

Referring to FIGS. 1, 5 and 6, the paddle-type operating handle 150 has a generally rectangular front wall 152 with a forwardly-turned lip 154 formed along one end, and a rearwardly-turned flange 157 at the other end. Substantially identical, rearwardly-turned side flanges 153, 155 border opposite sides of the rectangular front wall 152 and extend alongside the housing side walls 123, 125, respectively. A trigger 160 is welded to the handle side flange 153 to define a rearwardly projecting formation 175 that extends through the main back wall opening 142.

Figure 3:
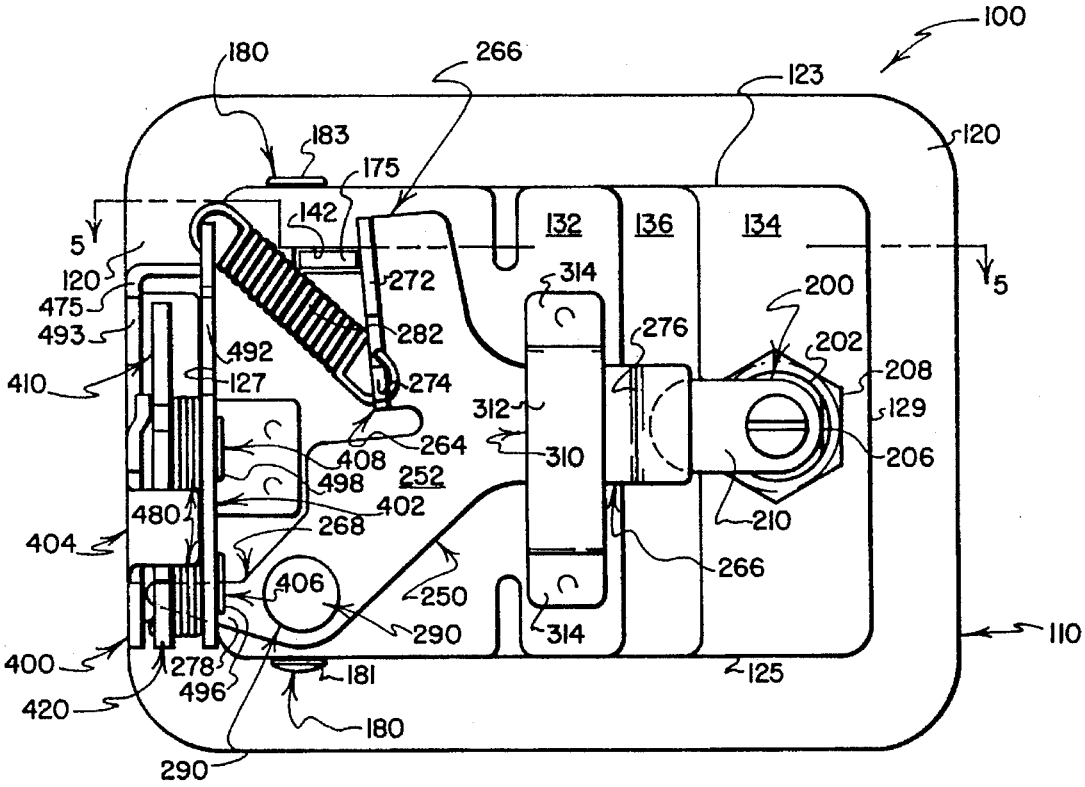
FIG. 3 is a rear elevational view thereof.

Referring to FIG. 1, a hinge pin 180 extends through aligned holes 190 that are formed through the side walls 123, 125 of the pan-shaped housing 120, and through aligned holes 192 that are formed through the rearwardly-turned side flanges 153, 155 of the paddle-type operating handle 150 to pivotally mount the handle 150 on the housing 110. Referring to FIG. 3, a head 181 is formed on one end of the pin 180. The pin 180 is secured in place in any of a variety of appropriate ways, for example by crimping or otherwise deforming the end of the pin 180 opposite the head 181 to provide a suitable enlargement 183.

When the operating handle 150 is pivoted about the axis of the pin 80 away from its normal, nested, "non-operated" position (depicted in FIG. 5) toward its extended, operated position (depicted in FIG. 6), the rearwardly extending handle-carried projection 175 is caused to move within the back wall opening 142 from a normal or "first" position that is depicted in FIG. 5 to a "second" position that is depicted in FIG. 6. As will be explained shortly, this movement of the tab 175 within the confines of the back wall opening 142 causes the operating arm 250 to pivot (from a "primary" position shown in FIG. 5 to a "secondary" position shown in FIG. 6) to "unlatch" the rotary latch subassembly 400 from latchingly engaging a suitably configured strike formation 50 (see FIGS. 7–9).

Referring to FIGS. 1, 5 and 6, to prevent the passage of unwanted moisture, debris and the like through the main back wall opening 142, a generally rectangular gasket 180 may be provided. The gasket 180 has a central opening 182 through which the projection 175 extends. As will be seen by comparing the positions of the gasket 180 as depicted in FIGS. 5 and 6, the gasket 180 preferably is connected to the trigger 160 so as to move with the handle 150 when the handle 150 pivots about the axis of the pin 180.

Figure 2:
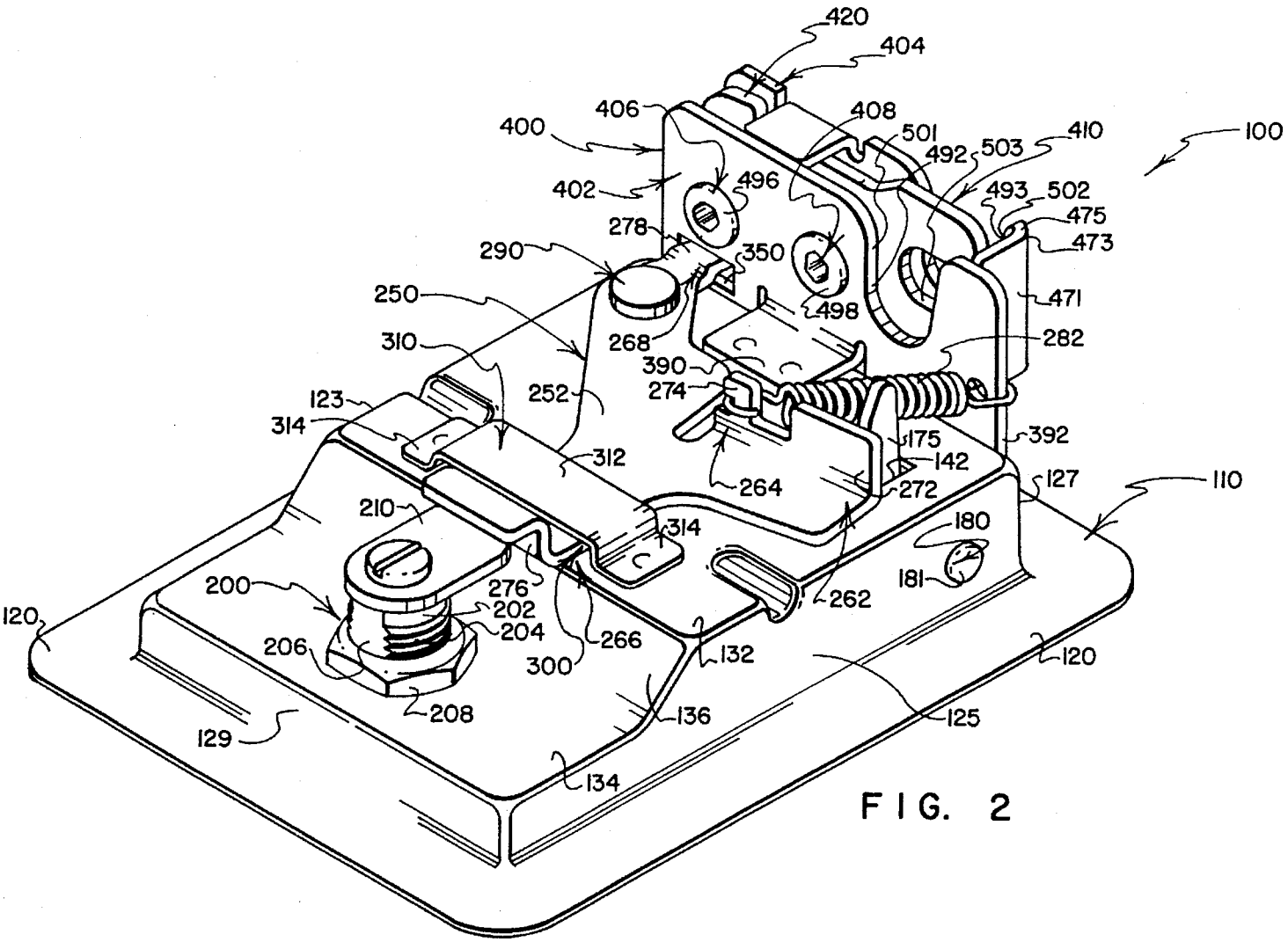
FIG. 2 is a rear perspective view, on an enlarged scale, showing the unit with its components assembled, with its rotary jaw in a latched position, with its operating arm in a primary position, and with its locking cam in a locked position—which necessitates that the paddle-type handle be in its normal, non-operated position.
Figure 4:
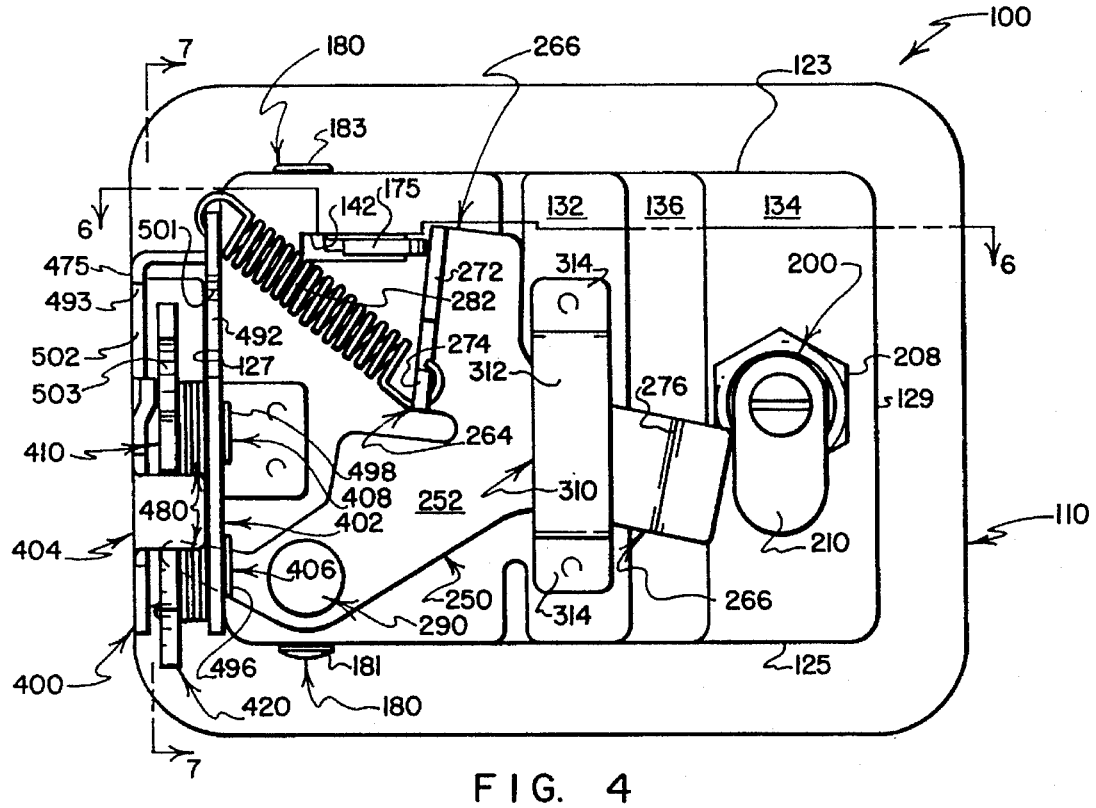
FIG. 4 is a rear elevational view similar to FIG. 3 but with the locking cam in an unlocked position, and with other components moved in response to movement of the paddle-type handle to its operated position, namely with the operating arm shown in its secondary position where it moves the rotary pawl to "unlatch" the rotary jaw, and with the rotary jaw in an unlatched position.

Referring to FIGS. 1–6, the key-operated lock mechanism 200 is a commercially purchased item that has a generally tubular body 202 that carries threads 204, with opposite side portions being flat as indicated by the numeral 206. The housing 202 is received in the lock mounting opening 144, with the flats 206 engaging the flats 146 to prevent the body 202 from rotating relative to the housing 110. A nut 208 is tightened on the threads 204 to mount the body 202 on the housing 110. Carried within the tubular body 202 is a key-operated rotatable plug 212 that carries a cam 210 at a location spaced rearwardly from the tubular housing 202. The cam 210 is movable between a "locked" position, as depicted in FIGS. 2, 3 and 5, and an "unlocked" position, as depicted in FIGS. 4 and 6.

Referring to FIGS. 1–4, the operating arm 250 has a bit of a complex configuration inasmuch as it is formed as a one-piece stamping that has a generally flat main portion 252 which defines a mounting hole 260 (see FIG. 1), and four non-coplanar "regions" 262, 264, 266, 268 that are provided to connect the operating arm 250 with four other components.

The connection region 262 includes a rearwardly-turned flange 272 that is engaged by the rearwardly extending projection 175 of the handle-carried trigger 160. The connection region 264 includes a small formation 174. A tension coil spring 282 connects with the formation 174 and with a side plate 402 of the assembly 400 to bias the operating arm 250 away from its second position (see FIG. 4) toward its first position (see FIGS. 2 and 3).

The connection region 266 includes a rearwardly extending surface 276 that is engaged by the cam 210 when the key-operated lock 200 positions the cam 210 in its locked position (shown in FIGS. 2, 3 and 5), but that is disengaged by the cam 210 when the key-operated lock 200 positions the cam 210 in its unlocked position (shown in FIGS. 4 and 6). At a location near the connection region 266 an elongate guide member 310 has a central region 312 arranged to overlie portions of the operating arm 250. Opposite end regions 314 of the guide member are welded to the main back wall portion 132 of the housing 110. By this arrangement, the guide member 310 and the back wall 132 cooperate to define a slide passage 300 (see FIG. 2) that receives portions of the operating arm located near the connection region 266 in a slip fit—to aid in guiding movements of the operating arm 250, and in supporting the operating arm 250 to resist deformation of the operating arm 250 during applications of undue force to the latch and lock unit 100.

The connection region 268 includes a pawl-engaging formation 278 for transferring "unlatching" movement to a rotary pawl 420 of the rotary latch assembly 400, as will be explained shortly. The pawl-engaging formation extends through a slot 350 formed in a housing side plate 402 of the rotary latch assembly 400. By this arrangement, and by sizing the slot 350 so that it relatively closely receives the pawl-engaging formation 278—to aid in guiding movements of the operating arm 250, and in supporting the operating arm 250 to resist deformation of the operating arm 250 during applications of undue force to the latch and lock unit 100.

A shoulder rivet 290 (or other suitable fastener) is rigidly connected to the main back wall portion 132 of the pan-shaped housing 110, and provides a central diameter 295 (see FIG. 1) that is received in a slip fit within the mounting hole 260 of the mounting arm 250—to mount the operating arm 250 on the housing 110 for pivotal movement relative thereto about the axis of the rivet 290.

Referring to FIG. 1, the latch assembly 400 has what will be referred to as a "housing" that consists of first and second "housing side plates" 402, 404 that are held together by two identical spacers or bushings 406, 408 that extend along transverse axes 456, 458.

The housing side plate 402 is substantially flat except for a central mounting tab 390 that extends substantially perpendicular to the plane of other portions of the housing side plate 402 at a location spaced between two other mounting tabs 392, 394. The tab 390 is welded to the end wall 127 of the pan-shaped housing 110. The tabs 392, 394 are welded to the main back wall portion 132 (see FIGS. 7–9).

The housing side plate 404 is substantially flat except 1) for an elongate recess 396 stamped therein, 2) for a pair of transversely extending flanges 471, 472 that are joined by small radius bends 473, 474, respectively, to the main flat portion 403 of the side plate 404.

The bushings or spacers 406, 408 are tubular (i.e., they have hollow interiors), and have reduced diameter end regions 416, 418 that are sized to be received in a slip fit within hex-shaped holes 426, 428 (see also FIG. 13) that are formed in the flat central portions 401, 403 of the side plates 402, 404, respectively. To securely retain the hollow, reduced diameter end regions 416, 418 in the hex-shaped holes 426, 428 (to thereby rigidly interconnect the housing side plates 402, 404), the end regions 416, 418 are deformed and enlarged to form heads 496, 498 (see FIG. 2) that have hollow interiors have end regions that tend to be of slightly hex shape after the end regions 416, 418 have been properly deformed to fully engage the sides of the hex-shaped holes 426, 428 during formation of the heads 496, 498. Because the holes 426, 428 are hex-shaped, and because the hollow end regions 416, 418 are expanded during formation of the heads 496, 498 to fully fill the hex-shaped holes 426, 428, good, secure, rotation-resistant connections are formed that rigidly interconnect the side plates 402, 404 and that resist loosening and rotation of the bushings 406, 408 relative to the side plates 402, 404.

Referring still to FIG. 1, the bushings 406, 408 are generally cylindrical, and provide stepped central regions that have relatively large diameter portions 436, 438 and relatively medium diameter portions 446, 448, respectively. The end and central regions 416, 436, 446 of the bushing 406 are concentric about the transversely extending axis 456. The end and central regions 418, 438, 448 of the bushing 408 are concentric about the transversely extending axis 458. Optional internal threads (not shown) may be formed within hollow interiors of the bushings 406, 408 to permit threaded fasteners of suitable size (not shown) to be connected to the subassembly 400 (should this be desirable for some purpose).

Figure 7:
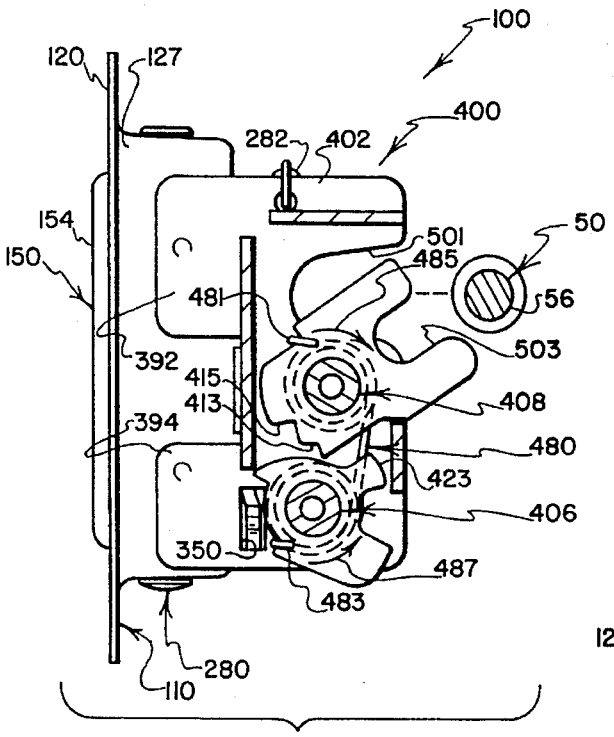
FIGS. 7, 8 and 9 are sectional views as seen generally from a plane indicated by a line A—A in FIG. 5, and depicting somewhat schematically a sequence of three steps by which a suitably configured strike comes to be received in and latchingly retained by rotary latch components of the first embodiment, with FIG. 7 showing the latch "unlatched" and the strike not yet engaging the latch, with FIG. 8 showing the strike being received by the latch and showing a preliminary latching orientation of latch components, and with FIG. 9 showing a fully latched configuration of the strike and latch components.
Figure 8:
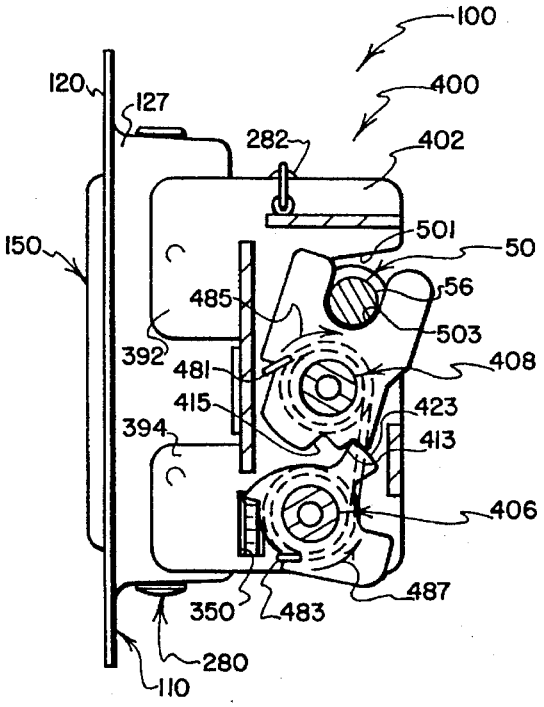
Figure 9:
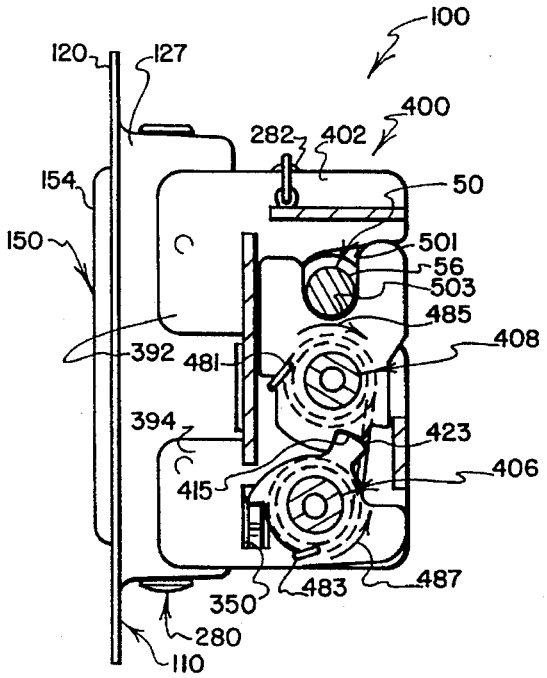

Referring to FIGS. 1 and 2, the side plates 402, 404 define aligned first and second U-shaped notches 501, 502, respectively, that open rearwardly with respect to a closure (not shown) on which the unit 100 is mounted so that, as the closure is moved toward its closed position, the resulting rearward movement of the side plates 402, 404 by the closure will cause the central region 56 of the strike 50 to be received within the first and second U-shaped notches 501, 502 (see FIGS. 7–9). Referring to FIGS. 1, 2, 7 and 9, a cooperating third U-shaped notch 503 is formed in the rotary jaw 410, and functions in concert with the first and second U-shaped notches 501, 502 to receive and latchingly retain the central region 56 of the strike 50 therein when the closure that mounts the unit 100 is closed.

A feature of the preferred practice of the present invention resides in the utilization of the second U-shaped notch 502 (either alone or in concert with the first U-shaped notch 501) to define a strike engagement surface (or surfaces) that is (are) directly engageable by the central region 56 of the strike 50. If the first and second U-shaped notches 501, 502 are identically configured and positioned to extend in congruent alignment, a pair of congruently aligned strike engagement surfaces 492, 493 are defined by the notches 501, 502—which are engageable by the central region 56 of the strike 50 as the central region 56 moves into and is latchingly retained within the U-shaped notches 501, 502. If, on the other hand, the first U-shaped notch 501 is configured such that it is wider than the second U-shaped notch 502 (so that the surfaces that define the first notch 501 are positioned such that they cannot physically engage the strike 50), the only strike engagement surface that will be defined by either of the notches 501, 502 is the strike engagement surface 493 that is defined by the second U-shaped notch 502.

By always ensuring that the strike engagement surface 493 is defined by the second U-shaped notch 502 (regardless of whether an additional strike engagement surface 492 is defined by the first U-shaped notch 501), advantage will always be taken of the close proximity presence to the second notch 502 (and to the strike engagement surface 493) of a transversely extending reinforcing flange 471 that is formed integrally with the second side plate 404 near one end thereof. A tight radius bend 473 connects the flange to a narrow portion 475 (see FIGS. 1 and 2) of the second side plate 404 that extends along one side of the second notch 502 (and that defines the strike engagement surface 493). The close proximity presence of the transversely extending flange 471 and the bend 473 to the second notch 502 (and to the strike engaging surface 493 that is defined by the second notch 502) strengthens and rigidifies the second housing side plate 404 in the critical area adjacent the strike engaging surface 493.

While the second U-shaped notch 502 could be configured such that it is wider than the first U-shaped notch 501 (whereby the only strike engagement surface that would be defined by either of the notches 501, 502 is the strike engagement surface 492 that is defined by the first U-shaped notch 501), this option does not conform to the preferred practice of the present invention unless the first side plate 402 is provided with a transversely extending flange (not shown) that is substantially identical to the depicted flange 471, but which extends from the first side plate 402 toward the second side plate 404 to bridge the space therebetween (instead of extending from the second side plate 404 toward the first side plate 402 to bridge the space therebetween, as does the depicted flange 471).

Referring to FIG. 1, housed between the side plates 402, 404 are the rotary jaw 410 and the rotary pawl 420. The rotary jaw 410 has a mounting hole 411 that receives the bushing diameter 448 therein in a slip fit to mount the rotary jaw 410 on the bushing 408 for limited angular movement about the transversely extending axis 458. The rotary pawl 420 has a mounting hole 421 that receives the bushing diameter 446 therein in a slip fit to mount the rotary pawl 420 on the bushing 406 for limited angular movement about the transversely extending axis 456.

Also housed between the side plates 402, 404 is a torsion coil spring 480 that has a first coil 486 that extends about the diameter 436 of the bushing 406, and a second coil 488 that extends about the diameter 438 of the bushing 408. An end 481 of the spring 480 engages the rotary jaw 410 for biasing the rotary jaw 410 in a direction of angular movement about the axis 458 that is indicated by an arrow 485. An opposite end 483 of the spring 480 engages the rotary pawl 420 for biasing the rotary pawl 420 in a direction of angular movement about the axis 456 that is indicated by an arrow 487.

Referring to FIGS. 7–9, the rotary jaw 410 and the rotary pawl 420 are provided with engageable formations 413, 423, respectively, that cooperate to "preliminarily latch" the rotary jaw 410 in engagement with the central region 56 of the strike 50 after the strike 50 has moved only a short distance into the aligned first and second U-shaped notches 501, 502 during movement of the closure toward its closed position.

The rotary jaw 410 and the rotary pawl 420 also are provided with engageable formations 415, 423, respectively, that cooperate to "fully latch" the rotary jaw 410 in engagement with the central region 56 of the strike 50 after the strike 50 has moved as far as it is going to move into the aligned first and second U-shaped notches 501, 502 as the closure is moved to its fully closed position. When the engageable formations 415, 423 are engaged (as is depicted in FIG. 9), the rotary jaw 410 is prevented by the rotary pawl 420 from executing unlatching movement until the rotary pawl 420 is rotated about the axis 456 to a pawl-releasing position wherein the engageable formations 415, 423 disengage to permit the rotary jaw 410 to rotate away from its fully latched position toward its unlatched position wherein the strike 50 is free to move out of the third U-shaped notch 503 that is defined by the rotary jaw 410. This type of pawl-controlled jaw latching action is well known to those who are skilled in the art, and is further illustrated and described in the patents that are identified above.

To move the rotary pawl 420 in opposition to the action of the torsion coil spring 480 (i.e., in a direction opposite the arrow 487) from a pawl-retaining position (depicted in FIG. 9) to a pawl-releasing position (depicted in FIG. 7), the operating arm 250 is pivoted (about the axis of the fastener 290 from the "primary" position depicted in FIG. 3 to the "secondary" position depicted in FIG. 4—which can only be done if the lock mechanism 200 has been operated to position the cam 210 in its unlocked position, as shown in FIG. 4) by operating the handle 150 (to pivot the handle 150 about the axis of the pin 180 from its normal non-operated position shown in FIGS. 1 and 5 to its operated position shown in FIG. 6). When the operated handle 150 is released, it returns to its non-operated position under the influence of the spring 282, hence the rearward extending projection 175 no longer remains in the "second" position of FIG. 4 where it holds the operating arm 250 in its "secondary" position (shown in FIG. 4). As the projection 175 returns to the "first" position of FIGS. 1 and 5, the operating arm 250 is caused to return to its "primary" position (shown in FIG. 3) due to the biasing action of the spring 282.

So long as the rotary jaw 410 of the latch assembly 400 is in its unlatched position (depicted in FIG. 7), the rotary jaw 410 always can be slammed into latching engagement with the strike 50. This is true regardless of how other relatively movable components of the unit 100 may be positioned. As the rotary jaw 410 receives the strike 50 within its third U-shaped notch 503, and as the strike 50 moves into the aligned first and second U-shaped notches 501, 502 of the housing side plates 402, 404, the strike 50 becomes cooperatively confined by the combined action of the first, second and third notches 501, 502, 503. When the strike 50 reaches the position that is depicted in FIG. 8, the rotary pawl 420 and the rotary jaw 410 become "preliminarily latched" (i.e., the engagement formations 413, 423 engage to prevent unlocking of the rotary jaw 410). When the strike 50 reaches the fully latched position depicted in FIG. 9, the engagement formations 415, 423 engage to fully lock the closure in its closed position.

So long as the key-locking assembly 200 positions the cam 210 in its "unlocked" position, as is depicted in FIGS. 4 and 6, pivotal movement of the operating arm 250 will not be impeded by the cam 210—hence, the operating handle 150 can be pivoted out of its nested, non-operated position (shown in FIG. 5) to its extended, operated position (shown in FIG. 6) to cause the projecting formation 175 to pivot the operating arm 250 to pivot the rotary pawl 420 away from its normal jaw-retaining position (shown in FIG. 9) toward its jaw-releasing position (shown in FIG. 7) to release the pawl formation 423 from engaging either of the jaw formations 413, 415, whereupon the rotary jaw 420 pivots under the influence of the spring 480 away from its latched position (shown in FIG. 9) to its unlatched position (shown in FIG. 7) to release the strike 50.

Figure 10:
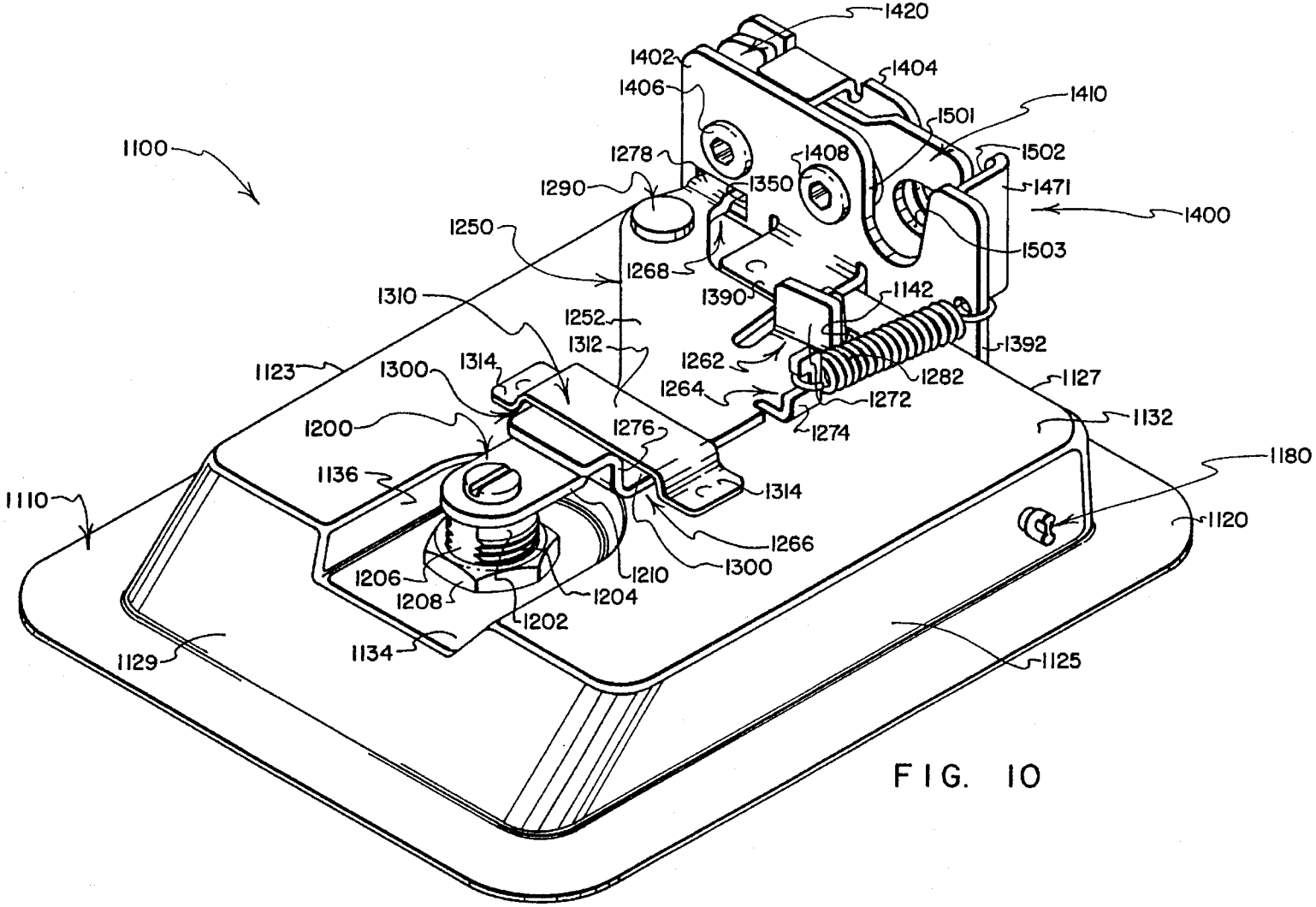
FIG. 10 is a rear perspective view of a second embodiment of a latch and lock unit that incorporates features of the invention, with its rotary jaw in a latched position, with its operating arm in a primary position, and with its locking cam in a locked position—which necessitates that its paddle-type handle be in its normal, non-operated position.
Figure 11:
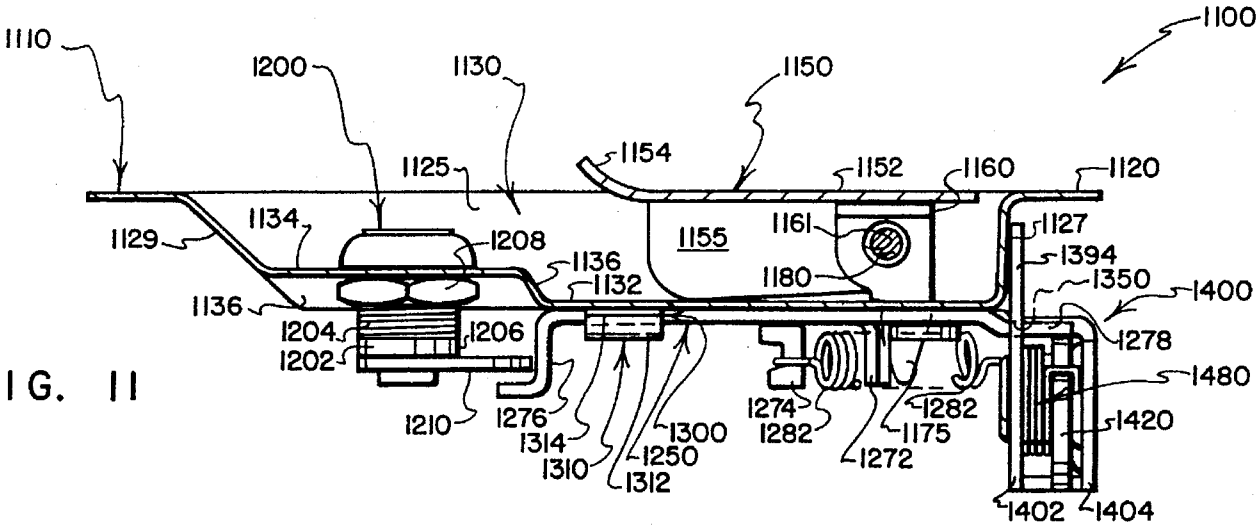
FIG. 11 is a side elevational view thereof, with selected components broken away and shown in section.
Figure 12:
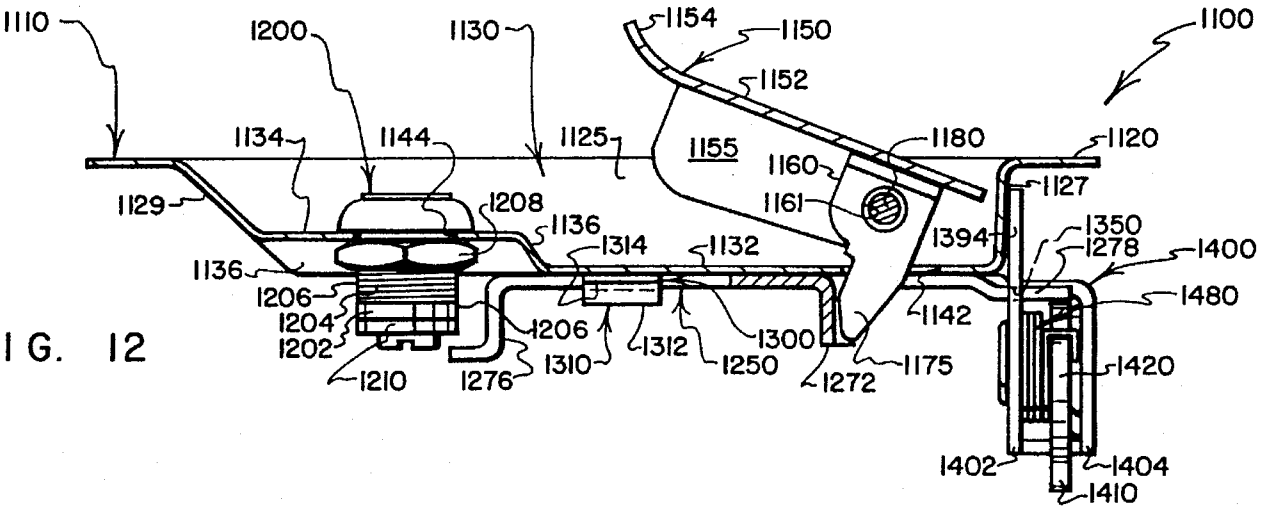
FIG. 12 is a view similar to FIG. 11 but with the locking cam in an unlocked position, and with additional component portions broken away to show portions of the paddle-type handle moved to its operated position which causes the operating arm to be moved to its secondary position which, in turn, permits the spring-biased pawl and jaw of the rotary latch assembly to "unlatch;"

Referring to FIGS. 10–12, a second embodiment 1100 of handle-operated latch and lock assembly that can be mounted as a unit on a closure (not shown) is depicted. The latch and lock unit 1100 has a pan-shaped housing 1110 onto which are mounted a paddle-type operating handle 1150, a key-operated cam lock assembly 1200, an operating arm 1250 and a rotary latch assembly 1400.

The pan-shaped housing 1110 is a generally rectangular metal stamping having a perimetrically extending, substantially flat mounting flange 1120 which surrounds a forwardly facing recess 1130. Opposed, relatively long side walls 1123, 1125, and opposed, relatively short end walls 1127, 1129 are joined by smooth bends to the mounting flange 1120. While the side and end walls 1123, 1125 and 1127 extend substantially perpendicular to an imaginary "front plane" within which the substantially flat mounting flange 1120 extends, the end wall 1129 is slanted or inclined with respect thereto.

A majority of the recess 1130 is relatively deep, and is closed by a main back wall portion 1132 that is substantially flat and that extends within an imaginary "back plane." One end portion of the recess 1130 is more shallow, and is closed by a minor back wall portion 1134 that also is substantially flat. The minor back wall portion 1134 extends in an imaginary "mid-plane" which parallels the imaginary "front" and "back" planes at a location substantially midway therebetween. A generally U-shaped, slightly inclined wall portion 1136 forms a transition between the back wall portions 1132, 1134, and smooth bends join the back wall portions to adjacent portions of the slanted end wall 1129.

Referring to FIG. 12 (where more component portions of the unit 1100 are broken away than is the case in FIG. 11), a main back wall opening 1142 is formed through the main back wall portion 1132. A lock mount opening 1144 is formed through the minor back wall portion 1134. While the drawings do not depict the exact configurations of the back wall openings 1142, 1144, those who are skilled in the art will understand that the main back wall opening 1140 is elongate and generally rectangular in nature (like the main back wall opening 142 of the unit 100); and that the lock mount opening 1144 preferably is identical to the lock mount opening 144 of the unit 100 so that a key-operated cam lock assembly 1200 that is identical to the key-operated cam lock assembly 200 can be mounted therein in precisely the same manner as the lock assembly 200 is mounted in the lock mount opening 144 of the unit 100.

The key-operated lock mechanism 1200 has a generally tubular body 1202 that carries threads 1204, with opposite side portions being flat as indicated by the numeral 1206, with a nut 1208 being provided to hold the lock assembly 1200 in place. Carried within the tubular body 1202 is a key-operated rotatable plug 1212 that carries a cam 1210 at a location spaced rearwardly from the tubular housing 1202. The cam 1210 is movable between a "locked" position, as depicted in FIGS. 10 and 11, and an "unlocked" position, as depicted in FIG. 12.

Referring to FIGS. 11 and 12, the paddle-type operating handle 1150 has a generally rectangular front wall 1152 with a forwardly-turned lip 1154 formed along one end. While only one rearwardly-turned side flange 1155 appears in FIGS. 11 and 12, it will be understood that the handle 1150 has a pair of substantially identical, opposed side flanges (in the manner that opposed side flanges 153, 155 are provided as integral portions of the handle 150 of the unit 100). A separately formed trigger 1160 is welded to the back side of the front wall 1152 to define a rearwardly projecting formation 1175 that extends through the main back wall opening 1142. A hole 1161 is provided through the trigger 1160, through which passes a pivot pin 1180 that pivotally mounts handle 1150 on the pan-shaped housing 1110 in the manner that the pivot pin 180 mounts the handle 150 on the pan-shaped housing 110.

When the operating handle 1150 is pivoted about the axis of the pin 1180 away from its normal, nested, "non-operated" position (depicted in FIG. 11) toward its extended, operated position (depicted in FIG. 12), the rearwardly extending handle-carried projection 1175 is caused to move within the back wall opening 1142 from a normal or "first" position that is depicted in FIG. 11 to a "second" position that is depicted in FIG. 12. In substantially the same manner that the movement of the tab 175 within the confines of the back wall opening 142 of the unit 100 causes the operating arm 250 to pivot (from a "primary" position shown in FIG. 5 to a "secondary" position shown in FIG. 6) to "unlatch" the rotary latch subassembly 400 from latchingly engaging a suitably configured strike formation 50 (shown in FIGS. 7–9), it will be understood that movement of the tab 1175 within the confines of the back wall opening 1142 of the unit 1100 causes the operating arm 1250 to pivot (from a "primary" position shown in FIG. 11 to a "secondary" position shown in FIG. 12) to "unlatch" the rotary latch assembly 1400 (which is identical to the rotary latch assembly 400 of the unit 100).

Referring to FIG. 10, the operating arm 1250 has a configuration that is much like that of the operating arm 250 inasmuch as it is formed as a one-piece stamping that has a generally flat main portion 1252 (through which a mounting hole, not shown, is formed in the manner that the mounting hole 260 is formed through the operating arm 250 of the unit 100 to receive portions of a fastener 1290 that mounts the operating arm 1250 on the back wall 1132 for pivotal movement about the axis of the fastener 1290), with four non-coplanar "regions" 1262, 1264, 1266, 1268 being provided to connect the operating arm 1250 with four other components.

The connection region 1262 employs a rearwardly-turned flange 1272 that is engaged by the rearwardly extending projection 1175 of the handle-carried trigger 1160. The connection region 1264 includes a small formation 1174. A tension coil spring 1282 connects with the formation 1174 and with a side plate 1402 of the rotary latch assembly 1400 to bias the operating arm 1250 away from its second position (see FIG. 12) toward its first position (see FIGS. 10 and 11).

The connection region 1266 includes a rearwardly extending surface 1276 that is engaged by the cam 1210 when the key-operated lock 1200 positions the cam 1210 in its locked position (shown in FIG. 10 and 11), but that is disengaged by the cam 1210 when the key-operated lock 1200 positions the cam 1210 in its unlocked position (shown in FIG. 12). At a location near the connection region 1266 an elongate guide member 1310 has a central region 1312 arranged to overlie portions of the operating arm 1250. Opposite end regions 1314 of the guide member are welded to the main back wall portion 1132 of the housing 1110. By this arrangement, the guide member 1310 and the back wall 1132 cooperate to define a slide passage or "slot" 1300 that receives portions of the operating arm located near the connection region 1266 in a slip fit—to aid in guiding movements of the operating arm 1250, and in supporting the operating arm 1250 to resist deformation of the operating arm 1250 during applications of undue force to the latch and lock unit 1100. The slide passage or "slot" 1300 is limited in length to accommodate the range of movement that needs to be executed by the operating arm 1250 in pivoting about the axis of a fastener 1290—just as the passage or "slot" 300 is limited in length to accommodate only the range of movement that needs to be executed by the operating arm 250 of the unit 100 in pivoting about the axis of the fastener 290.

The connection region 1268 includes a pawl-engaging formation 1278 for transferring "unlatching" movement to a rotary pawl 1420 of the rotary latch assembly 1400. The pawl-engaging formation 1278 extends through a slot 1350 formed in a housing side plate 1402 of the rotary latch assembly 1400. By this arrangement, and by sizing the slot 1350 so that it relatively closely receives the pawl-engaging formation 1278—to aid in guiding movements of the operating arm 1250, and in supporting the operating arm 1250 to resist deformation of the operating arm 1250 during applications of undue force to the latch and lock unit 1100. The slide passage or "slot" 1350 is limited in length to accommodate the range of movement that needs to be executed by the operating arm 1250 in pivoting about the axis of the fastener 1290—just as the passage or "slot" 350 is limited in length to accommodate only the range of movement that needs to be executed by the operating arm 250 of the unit 100 in pivoting about the axis of the fastener 200.

Inasmuch as the rotary latch assembly 1400 is identical to the rotary latch assembly 400, the description of its components and operation need not be repeated here. In FIGS. 10–12, numerals are provided to identify components of the rotary latch assembly 1400—which numerals are the same as those used in identifying the components and features of the rotary latch assembly 400 except that the "corresponding" component numerals used in FIGS. 10–12 are greater by a magnitude of one thousand than are the numerals used in identifying the components and features of the rotary latch assembly 400.

Figure 13:
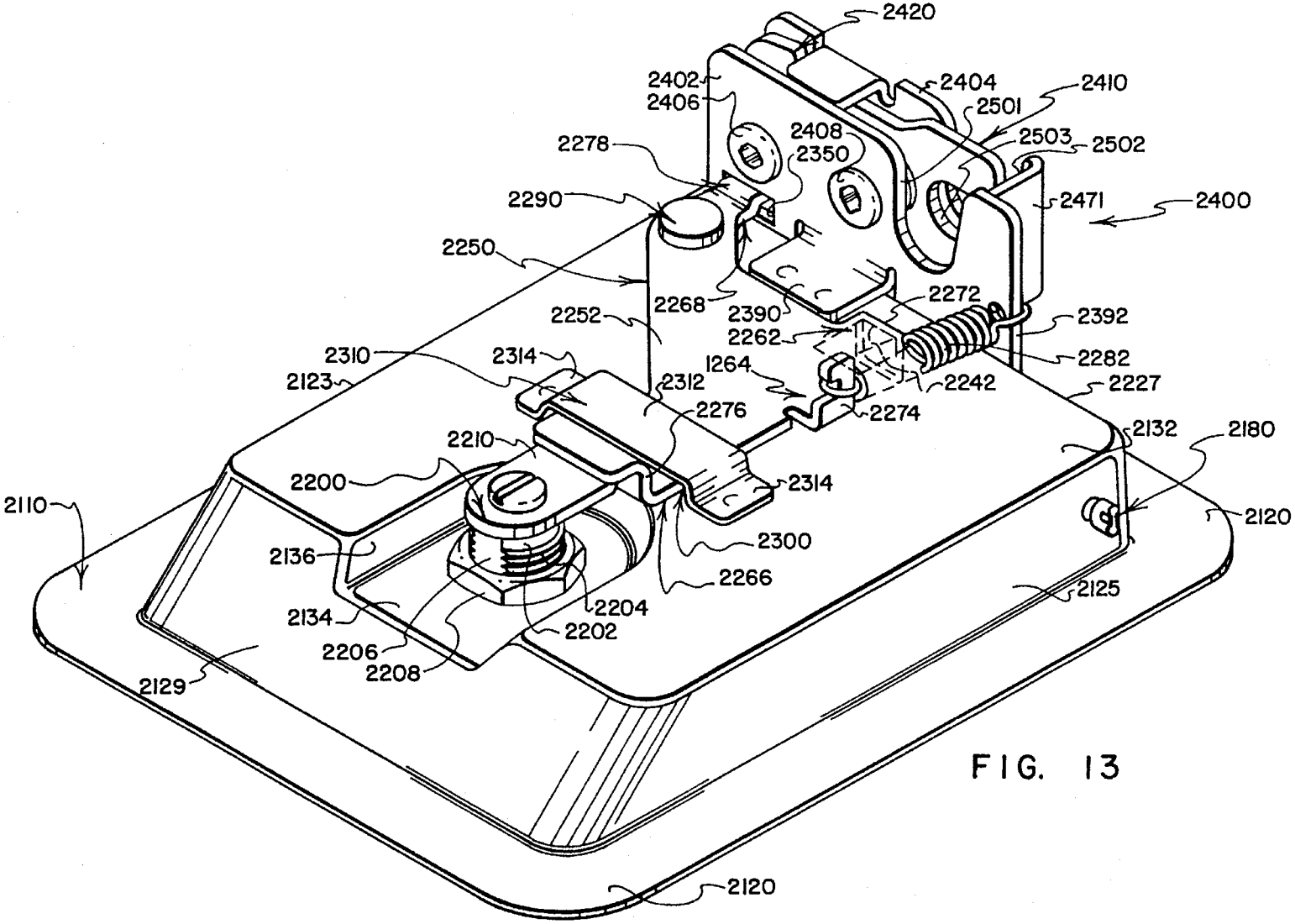
FIG. 13 is a rear perspective view of a third embodiment of a latch and lock unit that incorporates features of the invention, with its rotary jaw in a latched position, with its operating arm in a primary position, and with its locking cam in a locked position—which necessitates that its paddle-type handle be in its normal, non-operated position.
Figure 14:
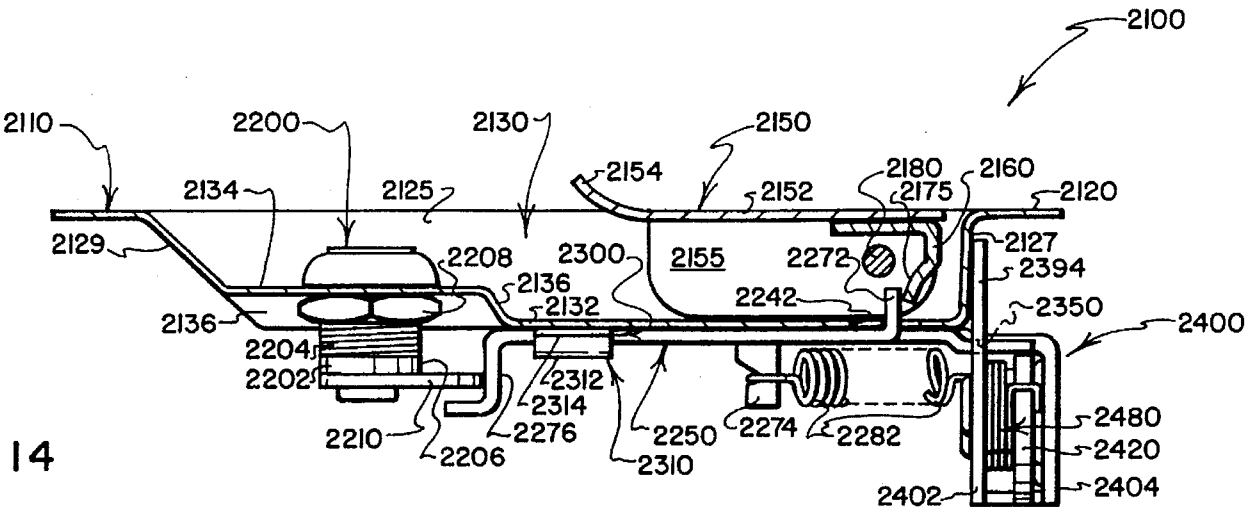
FIG. 14 is a side elevational view thereof, with selected components broken away and shown in section; and, FIG. 15 is a view similar to FIG. 14 but with the locking cam in an unlocked position, and with additional component portions broken away to show portions of the paddle-type handle moved to its operated position which causes the operating arm to be moved to its secondary position which, in turn, permits the spring-biased pawl and jaw of the rotary latch assembly to "unlatch."
Figure 15:
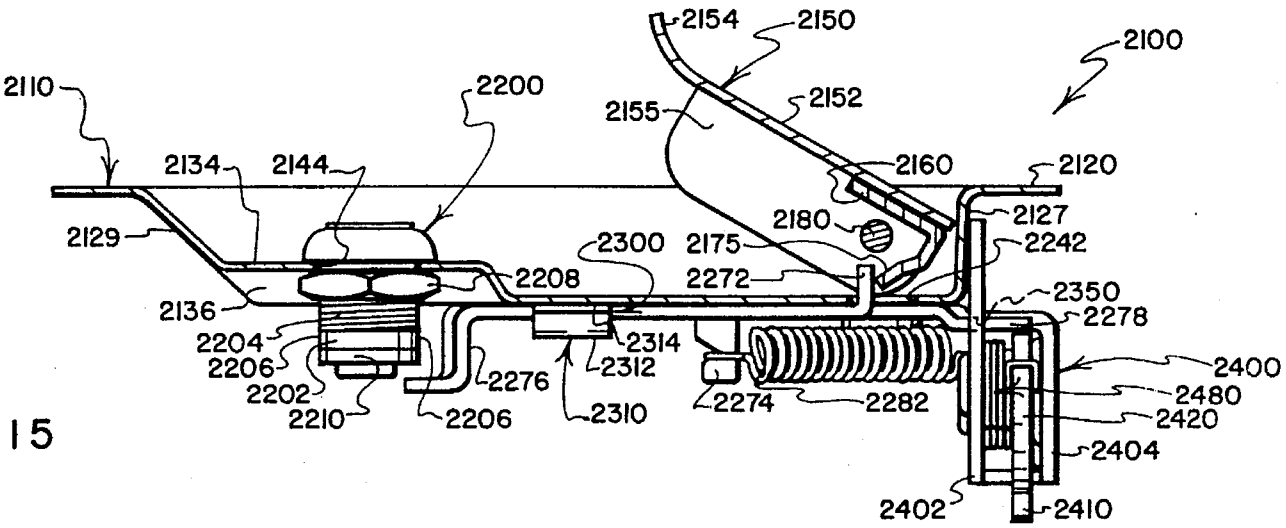

Referring to FIGS. 13–15, a third embodiment 2100 of handle-operated latch and lock assembly that can be mounted as a unit on a closure (not shown) is depicted. The latch and lock unit 2100 has a pan-shaped housing 2110 onto which are mounted a paddle-type operating handle 2150, a key-operated cam lock assembly 2200, an operating arm 2250 and a rotary latch assembly 2400.

The pan-shaped housing 2110 is a generally rectangular metal stamping having a perimetrically extending, substantially flat mounting flange 2120 which surrounds a forwardly facing recess 2130. Opposed, relatively long side walls 2123, 2125, and opposed, relatively short end walls 2127, 2129 are joined by smooth bends to the mounting flange 2120. While the side and end walls 2123, 2125 and 2127 extend substantially perpendicular to an imaginary "front plane" within which the substantially flat mounting flange 2120 extends, the end wall 2129 is slanted or inclined with respect thereto.

A majority of the recess 2130 is relatively deep, and is closed by a main back wall portion 2132 that is substantially flat and that extends within an imaginary "back plane." One end portion of the recess 2130 is more shallow, and is closed by a minor back wall portion 2134 that also is substantially flat. The minor back wall portion 2134 extends in an imaginary "mid-plane" which parallels the imaginary "front" and "back" planes at a location substantially midway therebetween. A generally U-shaped, slightly inclined wall portion 2136 forms a transition between the back wall portions 2132, 2134, and smooth bends join the back wall portions to adjacent portions of the slanted end wall 2129.

Referring to FIG. 15, a main back wall opening 2142 is formed through the main back wall portion 2132. A lock mount opening 2144 is formed through the minor back wall portion 2134. While the drawings do not depict the exact configurations of the back wall openings 2142, 2144, those who are skilled in the art will understand that the main back wall opening 2140 is generally rectangular in nature (like the main back wall opening 1142 of the unit 1100 but of a wider size); and that the lock mount opening 2144 preferably is identical to the lock mount opening 144 of the unit 100 so that a key-operated cam lock assembly 2200 that is identical to the key-operated cam lock assembly 200 can be mounted therein in precisely the same manner as the lock assembly 200 is mounted in the lock mount opening 144 of the unit 100.

The key-operated lock mechanism 2200 has a generally tubular body 2202 that carries threads 2204, with opposite side portions being flat as indicated by the numeral 2206, with a nut 2208 being provided to hold the lock assembly 2200 in place. Carried within the tubular body 2202 is a key-operated rotatable plug 2212 that carries a cam 2210 at a location spaced rearwardly from the tubular housing 2202. The cam 2210 is movable between a "locked" position, as depicted in FIGS. 13 and 14 and an "unlocked" position, as depicted in FIG. 15.

Referring to FIGS. 14 and 15, the paddle-type operating handle 2150 has a generally rectangular front wall 2152 with a forwardly-turned lip 2154 formed along one end. While only one rearwardly-turned side flange 2155 appears in FIGS. 13 and 14, it will be understood that the handle 2150 has a pair of substantially identical, opposed side flanges (in the manner that opposed side flanges 153, 155 are provided as integral portions of the handle 150 of the unit 100). An abbreviated trigger 2160 is welded to the back side of the front wall 2152 to define a rearwardly extending tab-like projection 2175 that extends toward but not through the main back wall opening 2142. A pivot pin 2180 pivotally mounts the handle 2150 on the pan-shaped housing in the manner that the pivot pin 180 mounts the handle 150 on the pan-shaped housing 110.

Referring to FIG. 13, the operating arm 2250 has a configuration that is much like that of the operating arm 250 inasmuch as it is formed as a one-piece stamping that has a generally flat main portion 2252 (through which a mounting hole, not shown, is formed in the manner that the mounting hole 260 is formed through the operating arm 250 of the unit 100) to receive portions of a fastener 2290 that mounts the operating arm 2250 on the back wall 2132 for pivotal movement about the axis of the fastener 2290), with four non-coplanar "regions" 2262, 2264, 2266, 2268 being provided to connect the operating arm 2250 with four other components.

The connection region 2262 employs a forwardly-turned flange 2272 that extends through the backwall opening 2142 to engage the rearwardly extending projection 2175 of the abbreviated trigger 2160. The engagement of the flange 2272 and the projection 2175 functions (in the same manner as does the engagement between the flange 1272 and the projection 1175 of the unit 1100) to cause the operating arm 2250 to be pivoted about the fastener 2290 in response to pivoting of the handle 2150 about the pivot pin 2180 (just as the operating arm 1250 pivots about the fastener 1290 in response to pivoting of the handle 1150 about the pivot pin 1180).

The connection region 2264 includes a small formation 2174. A tension coil spring 2282 connects with the formation 2174 and with a side plate 2402 of the rotary latch assembly 2400 to bias the operating arm 2250 away from its second position (see FIG. 15) toward its first position (see FIGS. 13 and 14).

The connection region 2266 includes a rearwardly extending surface 2276 that is engaged by the cam 2210 when the key-operated lock 2200 positions the cam 2210 in its locked position (shown in FIG. 13 and 14), but that is disengaged by the cam 2210 when the key-operated lock 2200 positions the cam 2210 in its unlocked position (shown in FIG. 15). At a location near the connection region 2266 an elongate guide member 2310 has a central region 2312 arranged to overlie portions of the operating arm 2250. Opposite end regions 2314 of the guide member are welded to the main back wall portion 2132 of the housing 2110. By this arrangement, the guide member 2310 and the back wall 2132 cooperate to define a slide passage or "slot" 2300 that receives portions of the operating arm located near the connection region 2266 in a slip fit—to aid in guiding movements of the operating arm 2250, and in supporting the operating arm 2250 to resist deformation of the operating arm 2250 during applications of undue force to the latch and lock unit 2100. The slide passage or "slot" 2300 is limited in length to accommodate the range of movement that needs to be executed by the operating arm 2250 in pivoting about the axis of a fastener 2290.

The connection region 2268 includes a pawl-engaging formation 2278 for transferring "unlatching" movement to a rotary pawl 2420 of the rotary latch assembly 2400. The pawl-engaging formation 2278 extends through a slot 2350 formed in a housing side plate 2402 of the rotary latch assembly 2400. By this arrangement, and by sizing the slot 2350 so that it relatively closely receives the pawl-engaging formation 2278—to aid in guiding movements of the operating arm 2250, and in supporting the operating arm 2250 to resist deformation of the operating arm 2250 during applications of undue force to the latch and lock unit 2100. The slide passage or "slot" 2350 is limited in length to accommodate the range of movement that needs to be executed by the operating arm 2250 in pivoting about the axis of the fastener 2290.

Inasmuch as the rotary latch assembly 2400 is identical to the rotary latch assembly 400, the description of its components and operation need not be repeated here. In FIGS. 13–15, numerals are provided to identify components of the rotary latch assembly 2400—which numerals are the same as those used in identifying the components and features of the rotary latch assembly 400 except that the "corresponding" component numerals used in FIGS. 13–15 are greater by a magnitude of two thousand than are the numerals used in identifying the components and features of the rotary latch assembly 400.

Such differences as exist among the components of the latch and lock embodiments 100, 1100, 2100 do not give rise to fundamental differences in the way in which the embodiments 100, 1100, 2100 function—as will be readily apparent to those who are skilled in the art.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable, handle-operable rotary lock for being mounted as a unit on a closure for releasably retaining the closure in a closed position by latchingly engaging a suitably configured strike formation that is located within relatively close proximity to the rotary lock when the closure is in its closed position, comprising:

a) a flush-mountable handle and housing assembly including:

i) a one-piece, flush-mountable, pan-shaped housing for mounting on a closure adjacent a mounting opening formed in the closure, with the housing having back and side wall portions that cooperate to define a forwardly facing recess, with the housing also having a substantially flat front mounting flange that extends in an uninterrupted manner about a front perimeter of the recess, with a major back wall portion being substantially flat and extending in a back wall plane that generally parallels a front plane in which the mounting flange extends, and with a back wall opening formed through the major back wall portion;

ii) an operating handle configured to be nestable within the recess at a location on the front side of the major back wall portion;

iii) pivot means connecting the operating handle to the pan-shaped housing for pivotal movement between a normal, non-operated position nested with the recess at a location on the front side of the major back wall portion, and an operated position wherein a normally nested portion of the handle projects forwardly from the recess;

b) a rotary latch assembly rigidly connected to the pan-shaped housing, including a rotary latch housing that has:

i) a one-piece, elongate, generally rectangular first housing side plate having opposed end regions near opposite ends of the length thereof, having a first side surface that extends lengthwise between the opposed end regions, and defining a first U-shaped notch that opens through the first side surface at a location near one of the opposed end regions of the first housing side plate;

ii) a one piece, elongate, generally rectangular second housing side plate having opposed end regions near opposite ends of the length thereof, having a second side surface that extends lengthwise between the opposed end regions, and defining a second U-shaped notch that opens through the second side surface at a location near one of the opposed end regions of the second housing side plate, with the first and second side surfaces extending in spaced, substantially parallel relationship, and with the second U-shaped notch being substantially aligned with the first U-shaped notch;

iii) spacer means for extending transversely between, for rigidly connecting with, and for maintaining a substantially parallel relationship between the first and second housing side plates, with the spacer means including a first spacer that extends along a first transverse axis that intersects each of the first and second housing side plates at a location that is relatively near to the other end regions thereof, and with the spacer means also including a second spacer that extends along a second transverse axis that intersects each of the first and second housing side plates at a location that is substantially mid-way between the opposite ends thereof;

c) plural connection means rigidly connecting the rotary latch housing to the pan-shaped housing, including a plurality of tab-like projections formed integrally with a chosen one of the first and second housing side plates, with at least one of the tab-like projections extending along and being rigidly connected to a chosen side wall portion of the pan-shaped housing, and at least another one of the tab-like projections extending along and being rigidly connected to the major back wall portion at a location near where said at least one of the tab-like projections extends along and is rigidly connected to said chosen side wall portion;

d) with the rotary latch assembly additionally including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the rotary latch housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch assembly latchingly engages the strike formation, and with a selected one of the first and second housing side plates being strengthened and enhanced in rigidity adjacent its associated U-shaped notch by the close proximity presence thereto of a transversely extending flange that is formed integrally with said selected housing side plate;

e) an operating arm connected to the major back wall portion for pivotal movement along the rear of the major back wall portion between primary and secondary positions about a pivot axis that extends substantially perpendicular to the major back wall portion, with the operating arm defining three spaced formations, with a first of the three formations being movable adjacent the back wall opening when the operating arm moves between its primary and secondary positions, with a second of the three formations being located generally one side of said pivot axis and being movable adjacent the rotary pawl of the rotary latch assembly to move the rotary pawl to release the rotary jaw from its latched position in response to movement of the operating arm from its primary position to its secondary position, and with a third of the three formations being located generally on an opposite side of said pivot axis and being spaced from the first and second of the three formations and being movable along a path of travel between a first position and a second position in response to movement of the operating arm between its primary and secondary positions;

d) locking means for being connected to the pan-shaped housing and for providing a locking member that is movable into and out of said path of travel to selectively block and permit movement of the operating arm between its primary and secondary positions;

e) projection means for extending through said back wall opening, for being rigidly connected to a selected one of the operating handle and the first of the three formations of the operating arm, and for being engaged by the other of the operating handle and the first of the three formations for establishing a driving connection between the operating handle and the operating arm that will cause the operating arm to move from its primary position toward its secondary position in response to movement of the operating handle from its non-operated position to is operated position, and for blocking movement of the operating handle from its non-operated position to its operated position when the locking member is moved into said path of travel to block movement of the operating arm from its first position to its and second position; and, f) first guide means for defining a first passage of limited length paralleling said back plane within which at least a part of the first of the three formations is movable during movement of the operating arm relative to the pan-shaped housing between the primary and secondary positions of the operating arm, and second guide means for defining a second elongate passage of limited length paralleling said back plane within which at least a part of the third of the three formations is movable during movement of the operating arm between the primary and secondary positions of the operating arm, with said first and second passages being configured to assist in confining said relative movement of the operating arm so as to limit such movement to pivotal movement about said axis to help ensure that other movement of the operating arm that might defeat the action of the lock is resisted.

2. The lock of claim 1 wherein:

a) the first spacer has opposed first end regions that extend into first openings formed in each of the first and second housing side plates at locations along said first transverse axis;

b) the second spacer has opposed second end regions that extend into second openings formed in each of the first and second housing side plates at locations along said second transverse axis; and, c) the first and second end regions are sized and configured to be received by the first and second openings in a tight fit that assists in maintaining a rigid connection between the first and second spacers and the first and second housing side plates.

3. The lock of claim 2 wherein each of the first and second openings is of hex shape, and each of the first and second end regions is expanded in an associated one of the first and second openings to take on a generally hex shape that assists in providing rigid connections between the first and second spacers and the first and second housing side plates, which connections serve well in resisting relative rotation between the first and second spacers and the first and second housing side place.

4. The lock of claim 1 wherein each of the tab-like projections is separately connected to one of said side wall portion or said back wall portion.

5. The lock of claim 4 wherein said tab-like projections are three in number, two of which are separately connected to said chosen side wall portion.

6. The lock of claim 1 wherein said plural connection means includes at least three of said tab-like projections, and said at least three tab-like projections are arranged in a row extending along the length of said chosen one of the first and second housing side plates, with end ones of the tab-like projections in said row both being connected to said chosen side wall portion of the pan-shaped housing.

7. The lock of claim 1 wherein the pan-shaped housing includes a minor back wall portion that is substantially flat and extends in a plane that parallels said front and back planes at a location therebetween, a lock mount opening is formed through said minor back wall portion, and said locking means is mounted on the pan-shaped housing with portions thereof extending through the lock mount opening.

8. The lock of claim 7 wherein said locking means is a key-operated lock that has a quarter-turn cam that defines said locking member.

9. The lock of claim 7 wherein the pan-shaped housing includes a transitional back wall portion that forms a transition between the major and minor back wall portions, said third of the three formations of the operating arm moves along said path of travel substantially adjacent said transitional back wall portion, and said second guide means includes a guide member that is connected to the major back wall portion at a location adjacent said transitional back wall portion and overlies the major back wall portion at said location to retain said third of the three formations in a space defined between the major back wall portion and said guide member.

10. The lock of claim 1 wherein said first guide means takes the form of an elongate slot formed in said chosen one of the first and second housing side plates, with the elongate slot having a length that extends in a direction that parallels said back plane.

11. The lock of claim 1 wherein the operating arm includes a fourth formation which is defined at a location spaced from the locations of the first, second and third of said three formations, and biasing means connects with the fourth formation for biasing the operating arm about said pivot axis in a direction that tends to move the operating arm away from its secondary position and toward its primary position.

12. The lock of claim 1 wherein said projection means is rigidly connected to the operating handle for movement therewith, and engages said first of three formations.

13. The lock of claim 1 wherein said projection means is an integral part of said operating arm that defines said first of three formations as extending through said back wall opening for being engaged by the operating handle.

14. The lock of claim of 1 wherein the first and second U-shaped notches open generally in a direction that is substantially opposite to a direction of travel that is followed by the closure in moving away from its closed position toward an open position, with each of the first and second notches being defined, at least in part, by a pair of spaced-apart side surfaces that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch.

15. The latch of claim 1 wherein the U-shaped notch that is defined by said selected housing side plate defines a strike engagement surface that is configured to be directly engaged by a strike formation that is received within the first, second and third U-shaped notches, said transversely extending flange is located in close proximity to the strike engagement surface, and said flange is connected to such portions of said selected housing side plate as define the strike engagement surface by a relatively small radius right angle bend, with said flange and said bend cooperating to rigidify and strengthen such portions of said selected housing side plate as define the strike engagement surface.

16. The latch of claim 1 wherein the first U-shaped notch is defined, at least in part, by an associated first strike engagement surface, the second U-shaped notch is defined, at least in part, by an associated second strike engagement surface, the first and second strike engagement surfaces are aligned so as to extend substantially congruently and are configured to be directly engaged by a strike formation that is received within the first, second and third U-shaped notches, said transversely extending flange is located in close proximity to a selected one of said associated strike engagement surfaces, said flange is connected to such portions of said selected housing side plate as define said selected associated strike engagement surface by a relatively small radius right angle bend, with said flange and said bend cooperating to rigidify and strengthen such portions of said selected housing side plate as define said selected associated strike engagement surface.

17. The latch of claim 1 wherein:

a) the first and second U-shaped notches open generally in a direction that is substantially opposite to a direction of travel that is followed by the closure in moving away from its closed position toward an open position;

b) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, c) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

18. The latch of claim 1 additionally including biasing means for biasing the operating handle toward its non-operated position.

19. The latch of claim 18 wherein said biasing means includes spring means connected to the operating arm and being operable through the projection means to bias the operating handle toward its non-operated position.

20. The latch of claim 1 additionally including gasket means extending about said projection means at a location near said back wall opening for sealing said back wall opening against penetration therethrough of foreign matter.

21. A flush-mountable, handle-operable rotary lock mountable as a unit on a closure for releasably retaining the closure in a closed position by latchingly engaging a suitably configured strike formation that is located within relatively close proximity to the rotary lock when the closure is in its closed position, comprising:

a) first housing means including a flush-mountable pan-shaped housing for mounting on the closure adjacent the mounting opening, including a one-piece housing that defines:

i) mounting flange means for defining a front wall of the pan-shaped housing, including a mounting flange that is configured 1) to extend perimetrically about the closure's mounting opening, 2) to closely overlie portions of a front surface of the closure's front wall that extend perimetrically about the mounting opening, and 3) to be clamped toward engagement with said portions of the closure's front surface to substantially flush-mount the pan-shaped housing on the closure;

ii) side walls and a back wall that cooperate to define a forwardly-facing recess, 1) with the side walls being configured to extend forwardly and rearwardly through the closure's mounting opening when the mounting flange closely overlies said portions of the closure's front surface, 2) the side walls having front portions that join smoothly with and being perimetrically surrounded by the mounting flange, 3) the side walls having rear portions that join smoothly with portions of the back wall, 4) with said portions of the back wall being configured to extend substantially parallel to the front wall of the pan-shaped housing, 5) with said portions of the back wall having a front surface that faces forwardly into the recess and a rearwardly-facing back surface on the opposite side thereof, and 6) with a main back wall opening formed through said portions of the back wall;

b) handle means including an operating handle that is at least partially nested within the recess, and that is connected to the first housing means for movement relative to the pan-shaped housing between a non-operated position and an operated position;

c) projection means connected to the handle and extending rearwardly through the opening formed in the back wall for being moved by movement of the handle 1) such that, when the handle is in the non-operated position, the projection means is caused by its connection to the handle to be in a first position, such that, 2) when the handle is moved from the non-operated position to the operated position, the projection means is caused by such movement to move from the first position to a second position, and such that, 3) when the handle is moved from the operated position to the non-operated position, the projection means is caused by such movement to move from the second position to the first position;

d) rotary means including second housing means rigidly connected to the mounting bracket means, with the second housing means including:

i) an elongate, generally rectangular first housing side plate having opposed end regions near opposite ends of the length thereof, and defining a first U-shaped notch located near one of the opposed end regions of the first housing side plate;

ii) an elongate, generally rectangular second housing side plate having opposed end regions near opposite ends of the length thereof, and defining a second U-shaped notch located near one of the opposed end regions of the second housing side plate, with the second U-shaped notch being substantially aligned with the first U-shaped notch;

iii) spacer means for extending transversely between, for rigidly connecting with, and for maintaining a substantially parallel relationship between the first and second housing side plates, with the spacer means including a first spacer that extends along a first transverse axis that intersects each of the first and second housing side plates at a location that is relatively near to the other end regions there of, and with the spacer means also including a second spacer that extends along a second transverse axis that intersects each of the first and second housing side plates at a location that is substantially mid-way between the opposite ends thereof;

e) with the rotary means additionally including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with said selected housing side plate;

f) operating arm means including an operating arm pivotally connected to the mounting bracket means and defining spaced first and second portions, with the first portion extending into engagement with said rearwardly projecting part of the projection means for being moved by the rearwardly projecting part of the projection means, with the second portion extending into engagement with the rotary pawl to effect movement of the rotary pawl to release the rotary jaw from being retained in its latched position in response to movement of the projection means by the handle when the handle moves away from its non-operated position toward its operated position, to thereby release the striker from being concurrently received within and latchingly retained within the confines of the first, second and third U-shaped notches; and, g) guide means connected to at least one of the first and second housing means for engaging the operating the first and second portions of the operating arm means to assist in supporting and guiding pivotal movement of the operating arm means.

22. The lock of claim 21 wherein the first and second U-shaped notches open generally in a direction that is substantially opposite to a direction of travel that is followed by the closure in moving away from its closed position toward an open position, with each of the first and second notches being defined, at least in part, by a pair of spaced-apart side surfaces that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch.

23. The lock of claim 21 wherein the U-shaped notch that is defined by said selected housing side plate defines a strike engagement surface that is configured to be directly engaged by a strike formation that is received within the first, second and third U-shaped notches, said transversely extending flange is located in close proximity to the strike engagement surface, and said flange is connected to such portions of said selected housing side plate as define the strike engagement surface by a relatively small radius right angle bend, with said flange and said bend cooperating to rigidify and strengthen such portions of said selected housing side plate as define the strike engagement surface.

24. The lock of claim 21 wherein the first U-shaped notch is defined, at least in part, by an associated first strike engagement surface, the second U-shaped notch is defined, at least in part, by an associated second strike engagement surface, the first and second strike engagement surfaces are aligned so as to extend substantially congruently and are configured to be directly engaged by a strike formation that is received within the first, second and third U-shaped notches, said transversely extending flange is located in close proximity to a selected one of said associated strike engagement surfaces, said flange is connected to such portions of said selected housing side plate as define said selected associated strike engagement surface by a relatively small radius right angle bend, with said flange and said bend cooperating to rigidify and strengthen such portions of said selected housing side plate as define said selected associated strike engagement surface.

25. The lock of claim 21 wherein:

a) the first and second U-shaped notches open generally in a direction that is substantially opposite to a direction of travel that is followed by the closure in moving away from its closed position toward an open position;

b) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, c) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

26. The lock of claim 21 wherein said designated part of the operating arm moves from a primary position to a secondary position along a path of movement in response to movement of the projection means from the first position to the second position, and wherein the latch additionally includes key-operated lock means that is connected to the first housing means and that includes locking formation means for being moved between locked and unlocked positions in response to operation of the lock means by a suitably configured key, with the locking formation means being configured, when in its locked position, to extend into said path of movement to block said movement along said path when the locking formation means is so extended, and with the locking formation means being configured to not impede said movement along said path when the locking formation means is in its unlocked position.

27. The lock of claim 21 additionally including biasing means for biasing the operating handle toward its non-operated position.

* * * * *